US011369966B2

(12) United States Patent
Anderson et al.

(10) Patent No.: US 11,369,966 B2
(45) Date of Patent: Jun. 28, 2022

(54) LAYERED STRUCTURE FOR IMPROVED SEALING OF MICROWELL ARRAYS

(71) Applicant: ARIZONA BOARD OF REGENTS ON BEHALF OF ARIZONA STATE UNIVERSITY, Scottsdale, AZ (US)

(72) Inventors: Clifford Anderson, Tempe, AZ (US); Kristen Lee, Mesa, AZ (US); Jacob Messner, Mesa, AZ (US); Laimonas Kelbauskas, Gilbert, AZ (US); Benjamin Ueberroth, Tempe, AZ (US); Yanqing Tian, Tempe, AZ (US); Deirdre Meldrum, Phoenix, AZ (US)

(73) Assignee: Arizona Board of Regents on Behalf of Arizona State University, Scottsdale, AZ (US)

( * ) Notice: Subject to any disclaimer, the term of this patent is extended or adjusted under 35 U.S.C. 154(b) by 683 days.

(21) Appl. No.: 15/760,984

(22) PCT Filed: Sep. 16, 2016

(86) PCT No.: PCT/US2016/052193

§ 371 (c)(1),
(2) Date: Mar. 16, 2018

(87) PCT Pub. No.: WO2017/049122

PCT Pub. Date: Mar. 23, 2017

(65) Prior Publication Data

US 2018/0264468 A1 Sep. 20, 2018

Related U.S. Application Data

(60) Provisional application No. 62/220,395, filed on Sep. 18, 2015.

(51) Int. Cl.
*B01L 3/00* (2006.01)

(52) U.S. Cl.
CPC ..... *B01L 3/50853* (2013.01); *B01L 2200/025* (2013.01); *B01L 2200/0689* (2013.01);
(Continued)

(58) Field of Classification Search
CPC ..... B01L 3/50853; B01L 2200/142; B01L 2200/141; B01L 2300/0627;
(Continued)

(56) References Cited

U.S. PATENT DOCUMENTS 6,171,780 B1 * 1/2001 Pham ..... B01L 3/5085 422/552
6,365,367 B1 4/2002 Friedman et al.
(Continued)

FOREIGN PATENT DOCUMENTS

WO 2009006457 A2 1/2009
WO 2010022391 A2 2/2010
WO 2015116627 A1 8/2015

OTHER PUBLICATIONS

Extended European Search Report for European Patent Application No. 16847415.3, dated Feb. 12, 2019, 8 pages.
(Continued)

*Primary Examiner* — Samuel P Siefke
*Assistant Examiner* — Quocan B Vo
(74) *Attorney, Agent, or Firm* — Withrow & Terranova, P.L.L.C.; Vincent K. Gustafson

(57) ABSTRACT

A multi-layer sealing structure for sealing a microwell array defined in or on a substrate includes at least one front compliant layer, a back compliant layer, and a flexural layer arranged between the at least one front compliant layer and the back compliant layer, wherein the at least one front compliant layer is closer than the back compliant layer to microwells of the microwell array. One or more front compliant layers may be optically reflective and/or may
(Continued)

embody a sensor layer. The back compliant layer may include an adhesive or various types of rubber, and the flexural layer may include a polymeric material or metal. A multi-layer sealing structure may be separated from a microwell array by peeling. A multi-layer sealing structure allows local disruption of sealing where particle contaminants are present without compromising the sealing performance of an entire microwell array, and without requiring a large sealing force.

19 Claims, 6 Drawing Sheets

(52) U.S. Cl.
CPC ... *B01L 2200/141* (2013.01); *B01L 2200/142* (2013.01); *B01L 2300/0627* (2013.01); *B01L 2300/0829* (2013.01); *B01L 2300/123* (2013.01); *B01L 2300/16* (2013.01)

(58) Field of Classification Search
CPC ..... B01L 2300/16; B01L 2200/025; B01L 2200/0689; B01L 2300/0829; B01L 2300/123; B01L 2200/087; B01L 2300/165; B01L 2300/041
See application file for complete search history.

(56) References Cited

U.S. PATENT DOCUMENTS 7,638,321 B2 12/2009 Teich et al.
7,851,201 B2 12/2010 Teich et al.
8,202,702 B2 6/2012 Neilson et al.
8,658,349 B2 2/2014 Teich et al.
8,697,431 B2 4/2014 Teich et al.
2003/0026739 A1* 2/2003 MacBeath ..... B01L 3/5085 422/417
2003/0190265 A1* 10/2003 Anazawa ..... B81B 1/00 422/537
2003/0190608 A1 10/2003 Blackburn
2004/0022677 A1* 2/2004 Wohlstadter ..... G01N 21/66 422/52
2004/0087033 A1 5/2004 Schembri
2005/0052646 A1* 3/2005 Wohlstadter ..... B01L 9/50 356/311
2009/0285719 A1 11/2009 Hirano et al.
2012/0276541 A1 11/2012 Lian
2013/0004967 A1* 1/2013 Halverson ..... B29C 59/046 435/7.8
2013/0115686 A1* 5/2013 Park ..... B01L 3/50255 435/287.2
2015/0087544 A1 3/2015 Putnam et al.
2015/0126404 A1 5/2015 Tian et al.

OTHER PUBLICATIONS

Author Unknown, "Materials Data Book: 2003 Edition," Cambridge University Engineering Department, Available online at: <<http://www-mdp.eng.cam.ac.uk/web/library/enginfo/cueddatabooks/materials.pdf>, 2003, 40 pages.
Lu, Hongguang, et al., "New ratiometric optical oxygen and pH dual sensors with three emission colors for measuring photosynthetic activity in Cyanobacteria," Journal of Materials Chemistry, vol. 21, Issue 48, Jan. 1, 2011, pp. 19293-19301.
"Molter, Timothy W., et al.,""A microwell array device capable of measuring single cell oxygen consumption10 rates,""Sensors and Actuators B Chemical, vol. 135, No. 2, Jan. 15, 2009, pp. 678-686".
Song, Ganquan, "Improved Microfabrication Technologies for Single Cell Metabolic Analysis," A Thesis Presented in Partial Fulfillment of the Requirements for the Degree Master of Science, Arizona State University, May 2014, 87 pages.
International Search Report and Written Opinion for International Patent Application No. PCT/US2016/052193, dated Nov. 18, 2016, 9 pages.
International Preliminary Report on Patentability for International Patent Application No. PCT/US2016/052193, dated Mar. 29, 2018, 8 pages.

* cited by examiner

| | | | | | | max D | min D | |
|---|---|---|---|---|---|---|---|---|
| | | | PET | Alum | Fused Silica | Alum | PET | Rubber |
| | | | A | B | C | E | F | D |
| E | Mpa | Young's modulus | 5000 | 68900 | 74000 | 68900 | 5000 | 100 |
| nu | | Poisson's ratio | 0.38 | 0.38 | 0.38 | 0.38 | 0.38 | 0.48 |
| t | mm | thickness | 0.05 | 0.02 | 0.5 | 0.1 | 0.025 | |
| D | kN-m | Plate constant | 61 | 54 | 900927 | 6711 | 8 | |

*FIG._5*

LAYERED STRUCTURE FOR IMPROVED SEALING OF MICROWELL ARRAYS

STATEMENT OF RELATED APPLICATION(S)

This application is a 35 U.S.C. § 371 national phase filing of International Application No. PCT/US2016/052193 filed Sep. 16, 2016, and claims the benefit of U.S. Provisional Patent Application No. 62/220,395 filed Sep. 18, 2015, wherein the disclosures of the foregoing applications are hereby incorporated by reference herein in their entireties.

GOVERNMENT RIGHTS IN INVENTION

This invention was made with government support under U01 CA164250 awarded by the National Institutes of Health. The government has certain rights in the invention.

TECHNICAL FIELD

This disclosure describes a layered structure for use in an apparatus for analyzing single living cells or groups of living cells that enables a seal for the majority of microwells in a microwell array in the presence of unwanted microscopic particles that contaminate the surface.

BACKGROUND

Microfluidic or microfabrication systems (also known as lab-on-a-chip') have been used for analyzing single cells or discrete groups of cells, and permitting analytes to be contained in hermetic microchambers or microwells that are isolated from external microenvironments. By segregating single cells or discrete groups of cells in different microwells, detection results specific to individual chambers and individual analytes may be obtained, even when multiple cell microwells are analyzed in a multiplexed fashion. An exploded cross-sectional illustration of a microwell 14 defined in a substrate of a microfluidic device and containing a single cell 18 is provided in FIG. 1. One or more layers of a microfluidic device, such as a substrate 10 defining a microwell array, or a cover 19, may be fabricated of substantially rigid materials such as fused silica, glass, and the like. As shown in FIG. 1, the microwell 14 includes a floor 15 that is recessed relative to a first surface 11 of the substrate 10, with the microwell 14 extending downward toward a second surface 12 that opposes the first surface 11. The cover 19 may be arranged in contact with the first surface 11 when it is desired to seal the microwell 14.

Undesired particles of microscopic size may contaminate surfaces of microwell arrays, and may be difficult to remove. The presence of particulate contamination may frustrate the ability to reliably seal microwell arrays without creating other difficulties.

Conventional glass-on-glass seals (such as disclosed by Molter, Timothy W., "A microwell array device capable of measuring single cell oxygen consumption rates," *Sens Actuators B Chem.* 2009 Jan. 15; 135(2): 678-686) are not very accommodating to particulate contamination. Molter describes the use of support pillars to promote uniform pressure and stress distribution and proper sealing of a base and a lid; however, such method does not specifically address particle contamination resulting in differences in points of sealing contact from a reference plane of a lid.

The following U.S. patents describe sealing methods which are appropriate for large microwells for bulk cell measurements, but are incompatible with measurements of single cells or small numbers of living cells: U.S. Pat. Nos. 7,638,321; 7,851,201; 8,202,702; 8,658,349; and 8,697,431. U.S. Pat. Nos. 7,638,321 and 7,851,201 describe mating cover and seating surfaces with optional auxiliary seating components that are well known to those familiar with standard sealing technologies. Microscopic particles around the size of 1 μm are difficult to remove from polymers due to van der Waals forces, especially if the particles are embedded in the polymer during dicing operations. Particles of this size are also very difficult to inspect over a 1000-well (or larger) microwell array with 6 $mm^2$ of surface area to be sealed. Even if particles are detected, it is very difficult to remove them mechanically. Use of a soft layer such as Shore A 70 durometer rubber for the main layer to which the sensor is attached, or such as the sensor matrix itself, is not compatible with live cell measurements in the context of microwell arrays. That is because the soft rubber layer would be extruded into the microwells, thereby elevating microwell pressure and thus affecting cell viability and/or cell response. Excessive distortion of an elastomer/sensor composite could also cause fracture of the sensor and/or impermeable layer.

One possible approach to promote microwell array sealing would be to select an interface layer or microwell lip coating material that is stiff enough not to extrude into the microwell (e.g., Parylene C) while providing a certain amount of compliance to microparticulate contamination. However, with such a material, the seal force required to accommodate particles in the 1 to 5 μm range is high. Parylene C can be deposited at a thickness of 1 to 5 μm, and possibly as high as 20 μm as an upper limit. At this thickness limit, the ability to accommodate particles of 5 μm size is limited. In addition, the modulus of elasticity of Parylene C (about 4 GPa) is too high to allow a reasonably low seal force. Moreover, such a technique cannot accommodate particles much bigger than about 2 to 10% of the thickness of the compliant coating layer without robbing other microwells in the microwell array of their share of the available sealing force. Because of the stiffness of a microwell-defining glass or fused silica substrate, any particle that is not completely consumed in the thickness of the compliant coating layer will result in seal failure for the majority or the entirety of the array. The larger the area of the particle contamination (e.g., including one or more particles) that is overcome by compliance, the lower the sealing force for the rest of the microwell array.

When single cells or discrete groups of cells are provided in microwells, it may be desirable to permit various conditions and/or metabolic parameters (e.g., oxygen, pH, etc.) to be sensed. Lu, H. et al ("New ratiometric optical oxygen and pH dual sensors with three emission colors for measuring photosynthetic activity in cyanobacteria," *Journal of Materials Chemistry,* 21 (2011) 19293) describes a sensor which can be fabricated in a film format; however measurements were made in a cuvette with a transparent cap not compatible with high-throughput metabolic measurements.

The art continues to seek improved structures for sealing microwell arrays, preferably in conjunction with sensing capability and/or compatibility, to address limitations associated with conventional devices. Desirable structures would be low in cost, robust to handling during fabrication (e.g., during sensor deposition), and tolerant to microscopic particles, thus allowing local disruption of sealing in locations where particle contaminants are present without compromising the sealing performance of an entire microwell array and without requiring a large sealing force.

SUMMARY

Aspects of this disclosure relate to a multi-layer sealing structure for use with a microwell array apparatus for analyzing single living cells or discrete groups of living cells.

In one aspect, the disclosure relates to a multi-layer sealing structure for sealing a microwell array defined in or on a substrate, wherein the multi-layer sealing structure includes at least one front compliant layer, a back compliant layer, and a flexural layer arranged between the at least one front compliant layer and the back compliant layer, and wherein the at least one front compliant layer is closer than the back compliant layer to microwells of the microwell array.

In certain embodiments, the at least one front compliant layer is substantially impervious to passage of gas (e.g., air) and/or evaporation of contents of a microwell. In certain embodiments, the at least one front compliant layer is optically reflective. In certain embodiments, the at least one front compliant layer comprises aluminum. In certain embodiments, the at least one front compliant layer comprises a plurality of front compliant layers. In certain embodiments, one front compliant layer of the plurality of front compliant layers embodies or includes a sensor layer. In certain embodiments, the sensor layer spans multiple microwells of a microwell array. In certain embodiments, a polymeric coating is arranged between the sensor layer and the at least one front compliant layer. In certain embodiments, the at least one front compliant layer comprises a thickness in a range of from 0.06 μm to 100 μm. In certain embodiments, the back compliant layer comprises an adhesive (e.g., an acrylic adhesive tape or a foam adhesive tape). In certain embodiments, the back compliant layer comprises foam rubber, solid rubber, or silicone rubber. In certain embodiments, the flexural layer comprises a polymeric material (e.g., the flexural layer comprises polyethylene terephthalate (PET)). In certain embodiments, the flexural layer comprises a metal (e.g., a flexural layer comprises aluminum). In certain embodiments, the flexural layer comprises a thickness in a range of from 25 μm to 100 μm. In certain embodiments, the flexural layer comprises a plate constant, D, in a range of from 8 kNm to 7000 kNm. In certain embodiments, the flexural layer comprises a modulus of elasticity of at least 1000 MPa.

In certain embodiments, a microfluidic device comprises a substrate defining a microwell array, and comprises a multi-layer sealing structure as described herein arranged to seal the microwell array. In certain embodiments, the multi-layer sealing structure may be removed from the substrate by peeling.

In another aspect, a method for arranging cellular material in a microwell array comprises: arranging cells or groups of cells in microwells of the microwell array, wherein each microwell of the microwell array includes a raised lip; and applying a multi-layer sealing structure as disclosed herein over the raised lip of each microwell to seal the cells or groups of cells in the microwells of the microwell array. In certain embodiments, the method further comprises removing at least a portion of the multi-layer sealing structure from at least some microwells of the microwell array by peeling the multi-layer sealing structure away from at least a portion of the microwell array.

In another aspect, any of the foregoing aspects, and/or various separate aspects and features as described herein, may be combined for additional advantage. Any of the various features and elements as disclosed herein may be combined with one or more other disclosed features and elements unless indicated to the contrary herein.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWINGS

FIG. 5 is a table including Young's modulus, Poisson's ratio, thickness, and plate constant values for portions of the substrate and multi-layer sealing structure of FIGS. 4A and 4B.

DETAILED DESCRIPTION

Figure 1:
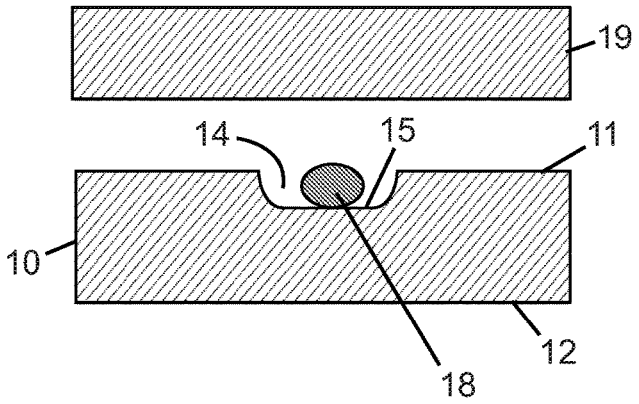
FIG. 1 (RELATED ART)
FIG. 1 is an exploded cross-sectional illustration of a microwell defined in a substrate of a microfluidic device and containing a single cell, with a conventional cover separated from the substrate.

Aspects of this disclosure relate to a multi-layer sealing structure for use with a microwell array for analyzing single living cells or discrete groups of living cells. A multi-layer sealing structure includes at least one front compliant layer, a back compliant layer; and a flexural layer arranged between the at least one front compliant layer and the back compliant layer. In certain embodiments, the at least one front compliant layer is optically reflective. In certain embodiments, the at least one front compliant layer comprises a plurality of front compliant layers. In certain embodiments, one front compliant layer of the plurality of front compliant layers comprises a sensor layer. Various multi-layer sealing structures disclosed herein are low in cost, robust to handling during fabrication, and tolerant to microscopic particles without compromising the sealing performance of an entire microwell array and without requiring a large sealing force.

In certain embodiments, a multi-layer sealing structure includes an internal flexural layer (e.g., flexible substrate) providing a degree of flexural rigidity, a compliant layer (e.g., a front compliant layer) that is relatively impervious and is preferably optically reflective, a relatively thin layer of compliant material (which may be a sensor layer) attached to this compliant layer, and another compliant layer attached to the back side of the flexural layer. In certain embodiments, the flexural layer may comprise a polymer, such as PET, and may be 25 to 100 μm thick. In certain embodiments, the at least one front compliant layer is preferably aluminum with at least 0.06 μm thickness for its oxygen barrier and optically reflective qualities, up to about 100 μm thickness. In certain embodiments, a relatively thick layer of aluminum may serve as a combination of any two or more of a flexural layer, an optically reflective layer, and a compliant layer. In certain embodiments, the optically reflective property of an optically reflective layer can approximately double the output of an optical sensor, or alternatively, allow an excitation dosage to be halved, in comparison to use of an absorptive or transparent layer. In certain embodiments, an aluminum layer may be deposited by standard evaporation techniques. In certain embodiments, an aluminum layer may be coated with a thin polymer layer for protecting an optically reflective aluminum surface reflectance prior to deposition of one or more sensor elements or layers. In certain embodiments, a mirror-like finish can be achieved, which is good for sealing and for minimizing optical aberrations that could affect data quality.

In certain embodiments, a back compliant layer is more compliant than the at least one front compliant layer. In certain embodiments, a back compliant layer comprises silicone rubber, e.g., 70 Shore A with an approximate thickness of 0.5 mm. In certain embodiments, a back compliant layer may comprise acrylic Pressure-Sensitive Adhesive (PSA), 50 to 125 μm thick, such as may be embodied or included in transfer tape or double-coated tape. In certain embodiments, a back compliant layer may comprise foam-based tape such as 3M 4016.

In certain embodiments, a multi-layer sealing structure may include a PET flexural layer, an evaporated aluminum layer, a protective coating for the evaporated aluminum layer, and a back layer of pressure sensitive adhesive. In certain embodiments, at least a portion of a multi-layer sealing structure may include 3M 850 film.

Figure 2:
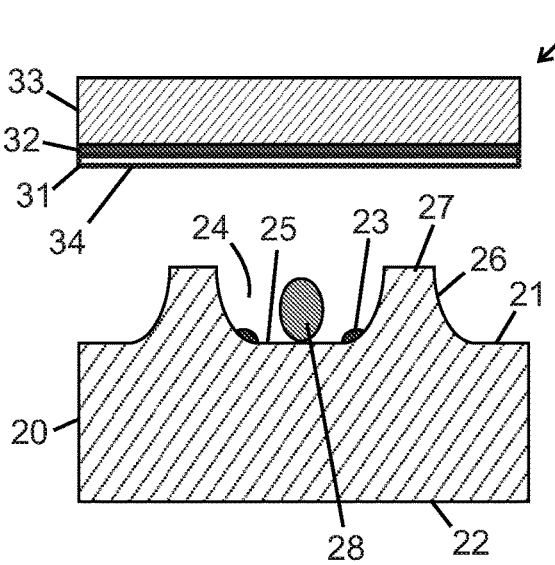
FIG. 2 is an exploded cross-sectional illustration of a microwell containing a single cell, the microwell defined within a recess formed by a lip protruding upward from a substrate of a microfluidic device and including oxygen sensing elements, with a multi-layer sealing structure separated from the substrate prior to sealing of the microwell.

FIG. 2 is an exploded cross-sectional illustration of a microwell 24 containing a single cell 28, wherein the microwell 24 is defined within a recess formed by a lip 26 protruding upward from a substrate 20 of a microfluidic device. The substrate 20 includes an upper surface 21 and a lower surface 22 that opposes the upper surface 21. The microwell 24 includes oxygen sensing elements 23 integrated into the microwell 24 proximate to a microwell floor 25. In certain embodiments, additional and/or different sensor types may be used. A multi-layer sealing structure 30, including a front compliant layer 31, a flexural layer 32, and a back compliant layer 33, is illustrated as separated from (i.e., above) the substrate 20, prior to sealing of the microwell 24. When it is desired to seal the microwell 24, a lower surface 34 of the multi-layer sealing structure 30 (including a surface of the front compliant layer 31) may be arranged to contact an upper surface 27 of the lip 26.

Figure 3:
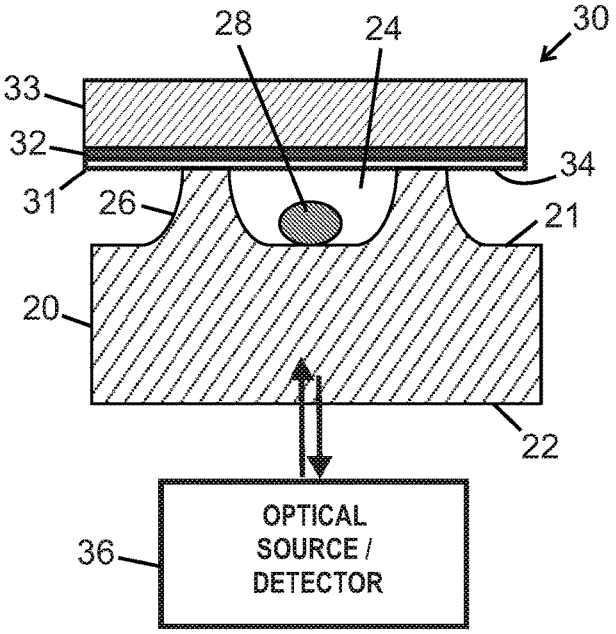
FIG. 3 is a cross-sectional illustration of a microwell containing a single cell, the microwell defined within a recess formed by a lip protruding upward from a substrate of a microfluidic device and being enclosed with a multi-layer sealing structure contacting the raised lip bounding the microwell, with an optical source and detector arranged proximate to the substrate.

FIG. 3 is a cross-sectional illustration of a microwell 24 containing a single cell 28, wherein the microwell 24 is defined within a recess formed by a lip 26 protruding upward from a substrate 20 of a microfluidic device. The microwell 24 is enclosed with a multi-layer sealing structure 30 contacting the raised lip 26 of the substrate 20 that laterally bounds the microwell 24. The substrate 20 includes an upper surface 21 and a lower surface 22 that opposes the upper surface 21. An optical source and detector 36 is provided below the lower surface 22 of the substrate 20 proximate to the microwell 24, with the optical source being arranged to transmit one or more wavelength bands or ranges (e.g., UV emissions, visible light emissions, and/or infrared emissions, including narrow or broad spectral output) into the microwell 24 to interact with its contents (including the single cell 28), and the optical detector being arranged to receive one or more wavelength bands or ranges following interaction with contents of the microwell 24. The substrate 20 is preferably transmissive of a broad spectrum of wavelengths, including one or more wavelength ranges identified above. In certain embodiments, fluorescence imaging may be used, in which a range of transmitted wavelengths includes a transmission wavelength peak (e.g., a single wavelength peak), and a range of received wavelengths includes a received wavelength peak (e.g., a single wavelength peak), wherein the range of transmitted wavelengths and the range of received wavelengths may include overlapping or non-overlapping ranges. In certain embodiments, multiple channels may provide independent transmit and receive functions. The multi-layer sealing structure 30 includes a front compliant layer 31, a flexural layer 32, and a back compliant layer 33, wherein the front compliant layer 31 embodies a lower surface 34 of the multi-layer sealing structure 30. In an embodiment wherein the multi-layer sealing structure 30 includes an optically reflective layer, such optically reflective layer may desirably reflect light to the detector portion of the optical source and detector 36.

Figure 4A:
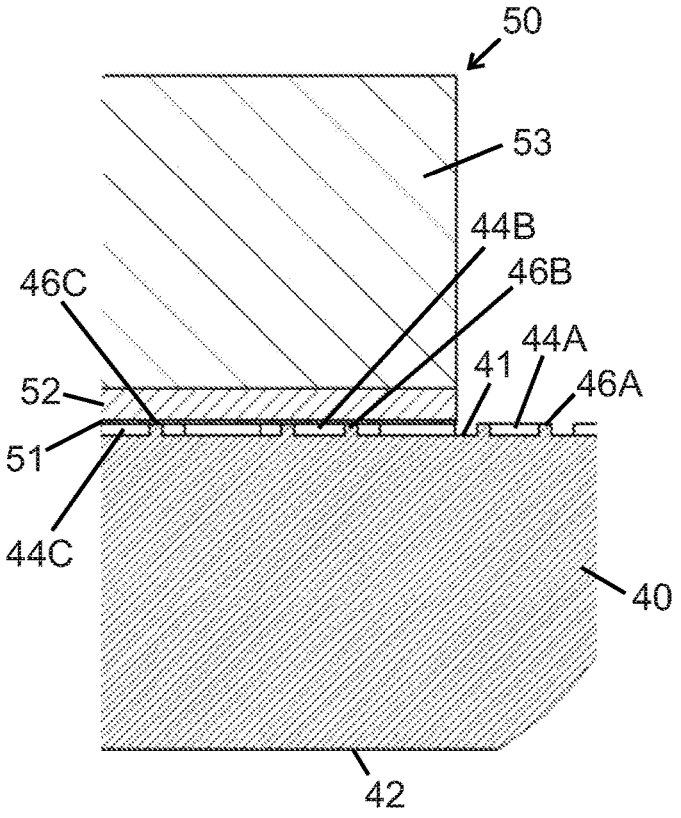
FIG. 4A is a cross-sectional illustration of a portion of a microfluidic device including a multi-layer sealing structure contacting raised lips of a substrate bounding a microwell.
Figure 4B:
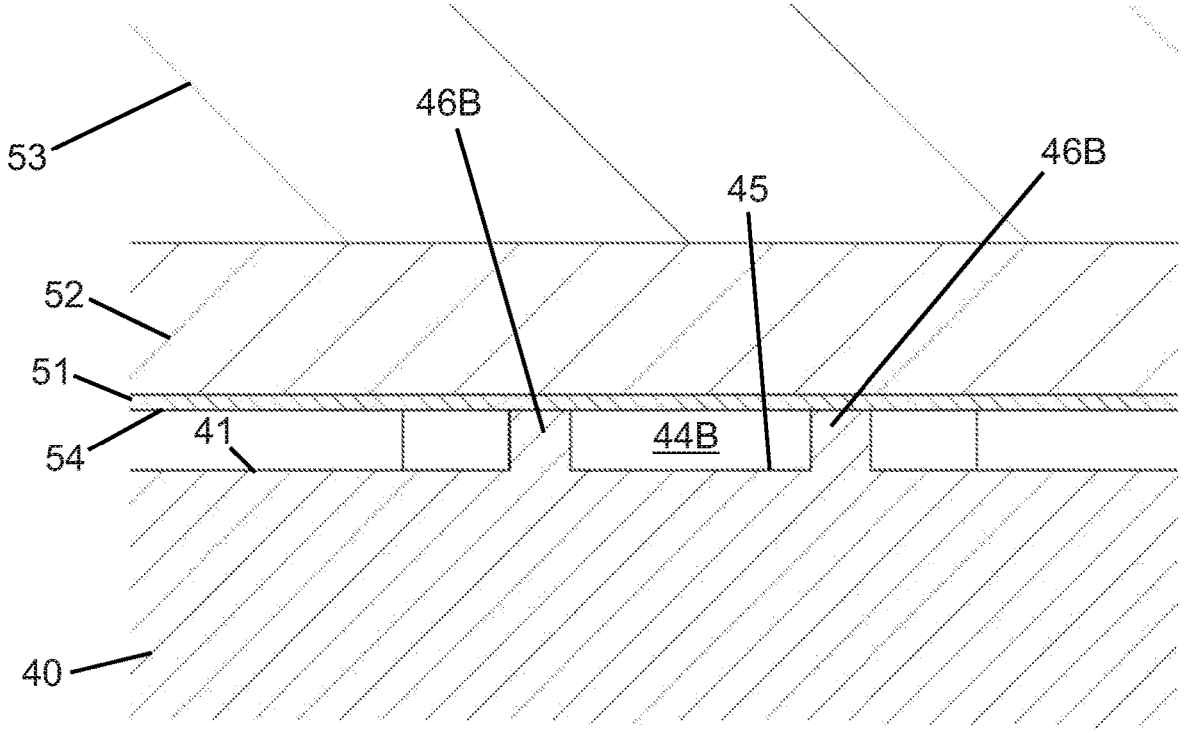
FIG. 4B is a magnified view of a portion of the substrate and multi-layer sealing structure illustrated in FIG. 4A.

FIG. 4A is a cross-sectional illustration of a portion of a microfluidic device including a multi-layer sealing structure 50 contacting raised lips 46A-46C of a substrate 40 that bound microwells 44A-44C, with each microwell 44A-44C including a microwell floor 45 (as shown in FIG. 4B). FIG. 4B is a magnified view of a portion of the substrate and multi-layer sealing structure illustrated in FIG. 4A. The substrate 40 includes an upper surface 41 and a lower surface 42 that opposes the upper surface 41. The raised lips 46A-46C extend upward from the upper surface 41. The multi-layer sealing structure 50 includes a front compliant layer 51, a flexural layer 52, and a back compliant layer 53, with a lower surface 54 of the front compliant layer 51 being arranged in contact with an upper surface of the raised lips 46A-46C.

FIG. 5 is a table including Young's modulus, Poisson's ratio, thickness, and plate constant values for portions of a substrate and multi-layer sealing structure such as illustrated in FIGS. 4A and 4B. In certain embodiments, a flexural layer may include a plate constant, D, in a range of from 8 to 7000 kNm. In certain embodiments, Young's modulus (also known as modulus of elasticity) of the flexural layer may be in a range of at least 1000 MPa.

In certain embodiments, a multi-layer sealing structure includes at least one front compliant layer, a back compliant layer; and a flexural layer arranged between the at least one front compliant layer and the back compliant layer. In certain embodiments, the at least one front compliant layer is optically reflective. In certain embodiments, the at least one front compliant layer comprises aluminum. In certain embodiments, the multi-layer sealing structure includes at least one front compliant layer and an impervious layer arranged between the at least one front compliant layer and microwells of the microwell array. In certain embodiments, the at least one front compliant layer comprises a plurality of front compliant layers. In certain embodiments, one front compliant layer of the plurality of front compliant layers embodies or includes a sensor layer. In certain embodiments, the sensor layer spans multiple microwells of a microwell array. In certain embodiments, a polymeric coating is arranged between the sensor layer and the at least one front compliant layer. In certain embodiments, the at least one front compliant layer comprises a thickness in a range of from 0.06 μm to 100 μm. In certain embodiments, the back compliant layer comprises an adhesive (e.g., an acrylic adhesive tape or a foam adhesive tape). In certain embodiments, the back compliant layer comprises foam rubber, solid rubber, or silicone rubber. In certain embodiments, the flexural layer comprises at least one polymeric material (e.g., the flexural layer comprises a PET). In certain embodiments, the flexural layer comprises a metal (e.g., the flexural layer comprises aluminum). In certain embodiments, the flexural layer comprises a thickness in a range of from 25 μm to 100 μm. In certain embodiments, the flexural layer comprises a plate constant, D, in a range of from 8 kNm to 7000 kNm. In certain embodiments, the flexural layer comprises a modulus of elasticity of at least 1000 MPa.

Figure 6:
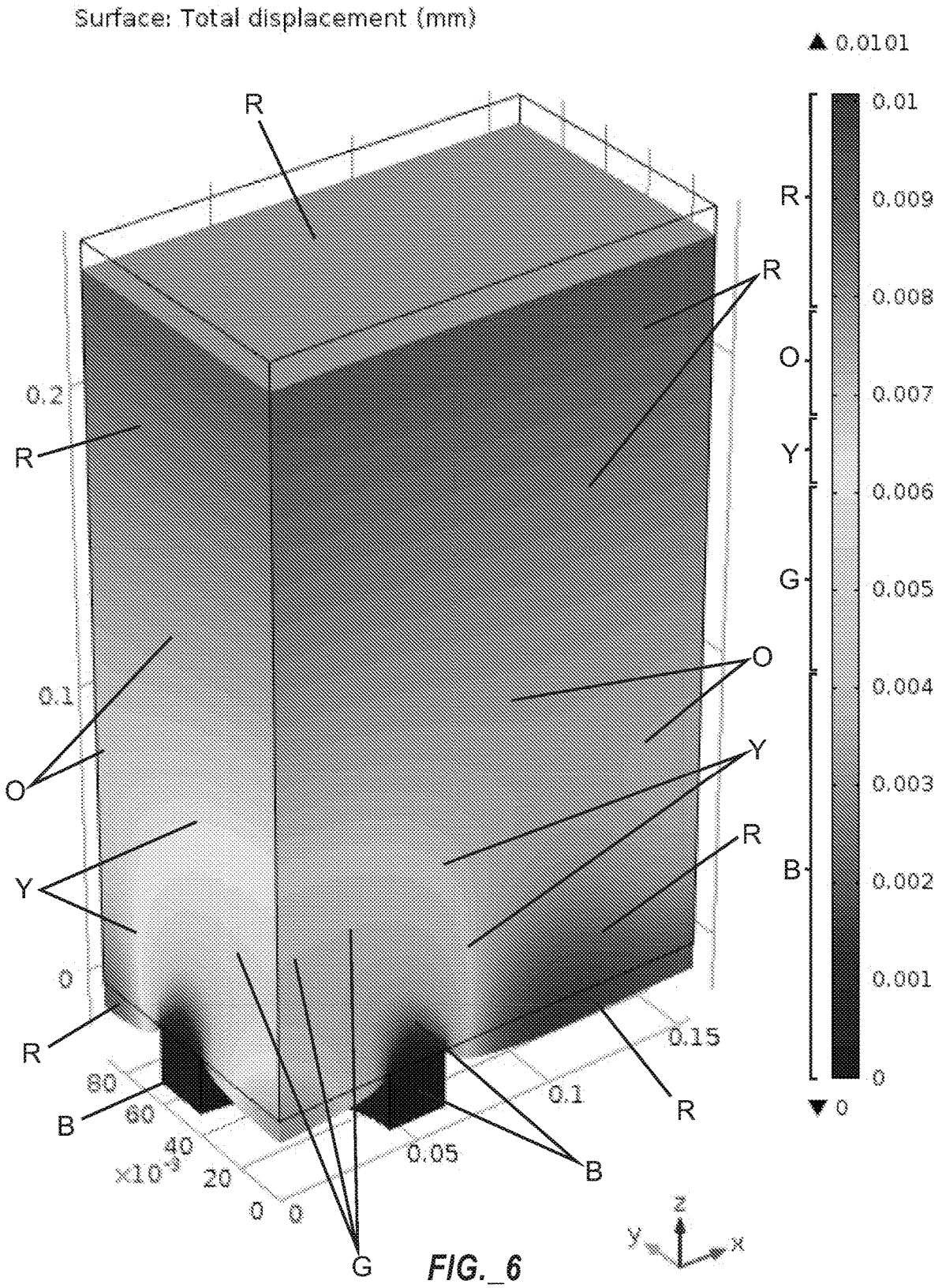
FIG. 6 is a deformation plot (to scale) of a single thick back compliant layer, wherein E=100 MPa (approximately 70 Shore A durometer rubber), displacement at the center of the microwell is 7.5 μm, well depth is 20 μm, and X, Y, Z units are shown in mm.

FIG. 6 is a deformation plot (to scale) of a single thick back compliant layer, wherein E=100 MPa (approximately 70 Shore A durometer rubber), displacement at the center of the microwell is 7.5 μm, well depth is 20 μm, and X, Y, Z units are shown in mm. FIG. 6 is a quarter-symmetry linear FEA model with one quarter of a first microwell arranged at the lower/front cover of the model and one quarter of a second microwell arranged diagonally opposite and not visible in this view. FIG. 6 is converted to grayscale from a diagram originally rendered in color, with the legend at right including letters identifying colors as follows: R denotes red, O denotes orange, Y denotes yellow, G denotes green, and B denotes blue. Corresponding letters and lead lines indicating colors have been added to the FEA model depicted in FIG. 6. The applied load on the top surface was 12.5 MPa, which results in an average seal pressure of about 50 MPa on the microwell lips. The deflection at the center of the microwell is 7.5 μm and the maximum principal strain is 37% at the edge of the microwell lips. The modulus is 100 MPa, approximately equivalent to standard polyurethane O-ring material P064270, 70 Shore A. The value of 50 MPa was chosen because it represents the peak contact stress for 32% squeeze for unrestrained loading and plane strain. Lower loading of the simple elastomeric backing is not likely to be successful due to manufacturing tolerances, surface roughness and compression set. According to the Parker O-Ring Handbook, ORD 5700, "the minimum squeeze for all seals, regardless of cross-section should be about 0.2 mm. The reason is that with a very light squeeze almost all elastomers quickly take 100% compression set."

A conventional substrate including fused silica at 0.5 mm thickness has a plate constant over 100 times higher than the maximum specified.

Figure 7:
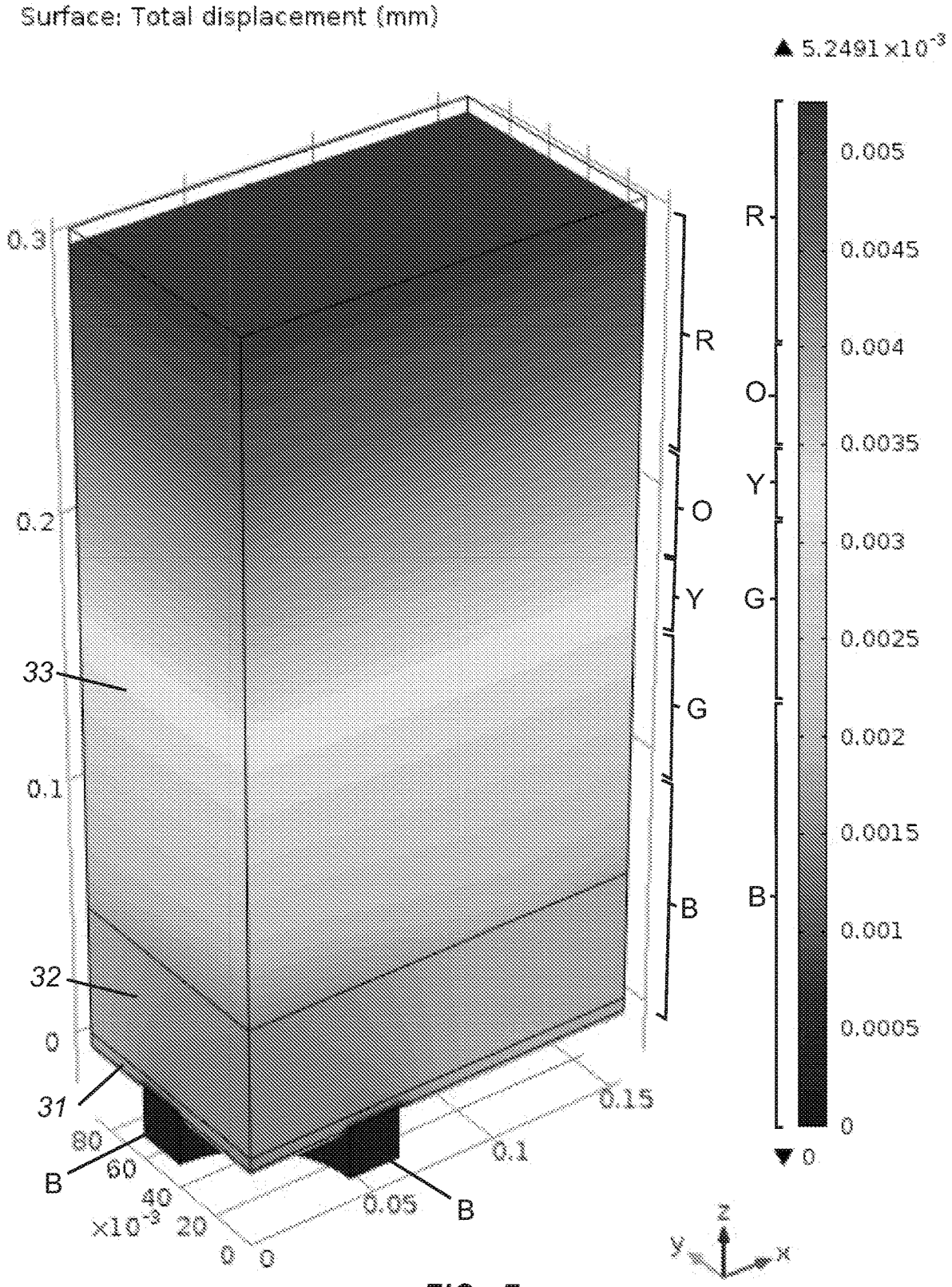
FIG. 7 is a cross-sectional deformation plot of a three-layer sealing structure, including a 70 Shore A elastomer back compliant layer (top, 0.5 mm); PET flexural layer (middle, 0.05 mm); and front compliant sensor layer (bottom, 0.005 mm) under normal conditions without particle contamination.

FIG. 7 is a cross-sectional deformation plot of a three-layer sealing structure, including a 70 Shore A elastomer back compliant layer 33 (top, 0.5 mm); PET flexural layer 32 (middle, 0.05 mm); and front compliant sensor layer 31 (bottom, 0.005 mm) under normal conditions without particle contamination. FIG. 7 is a quarter-symmetry linear FEA model with one quarter of one microwell arranged at the lower/front cover of the model. FIG. 7 is converted to grayscale from a diagram originally rendered in color, with the legend at right including letters identifying colors as follows: R denotes red, O denotes orange, Y denotes yellow, G denotes green, and B denotes blue. Corresponding letters and lead lines indicating colors have been added to the FEA model depicted in FIG. 7. The microwell shown is from a separate substrate (assembled at seal); with a 12.5 MPa load on the back compliant layer 33. The maximum deflection into the microwell is 0.0014 mm in this case. In certain embodiments, a significantly lower load can be used, because a multi-layer closure including the flexural layer, the back compliant layer, and at least one front compliant layer (which may include or embody the sensor layer) accommodates particle contamination, surface irregularities, and manufacturing tolerances such as non-flatness of the force-producing seal fixture. Peak and average displacements are much smaller for the FEA model of FIG. 7 than for the FEA model of FIG. 6.

Figure 8:
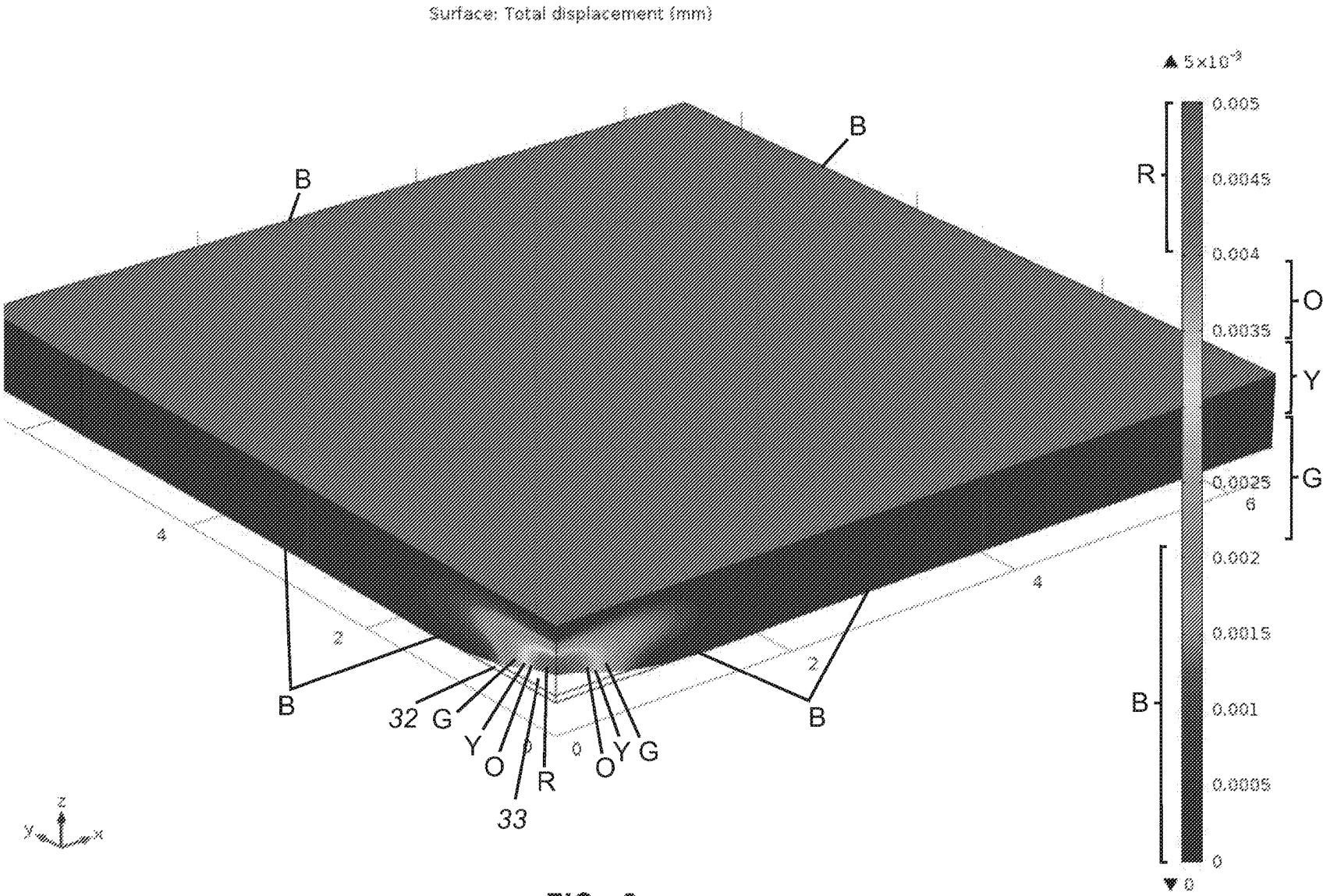
FIG. 8 is a cross-sectional deformation plot of a multi-layer sealing structure subject to a single 0.005 mm particle causing local deformation, with the multi-layer sealing structure including a 70 Shore A elastomer back compliant layer (top, 0.5 mm); and a PET flexural layer (middle, 0.05 mm), wherein a sensor layer intended for inclusion on the bottom is omitted because it does not appreciably affect deflection of the flexural layer, with the assembly subject to a reaction force of 0.073 Nt.

FIG. 8 is a cross-sectional deformation plot of a multi-layer sealing structure subject to a single 0.005 mm particle causing local deformation, with the multi-layer sealing structure including a 70 Shore A elastomer back compliant layer 33 (top, 0.5 mm); and a PET flexural layer 32 (middle, 0.05 mm), wherein a sensor layer intended for inclusion on the bottom is omitted because it does not appreciably affect deflection of the flexural layer 32, with the assembly subject to a reaction force of 0.073N. FIG. 8 is converted to grayscale from a diagram originally rendered in color, with the legend at right including letters identifying colors as follows: R denotes red, O denotes orange, Y denotes yellow, G denotes green, and B denotes blue. Corresponding letters and lead lines indicating colors have been added to FIG. 8.

A particle of 0.005 mm size, applied as a constrained displacement of 0.005 mm, results in a deflection profile that affects microwells (not shown) approximately 0.5 mm away from the particle, or with an area of about 0.2 $mm^2$. For a 1023 microwell array with staggered pitch of 0.155×0.09 mm, well density is 37.6 microwells per/$mm^2$. Thus, about 7 microwells would be affected. The reaction force of 0.073 Nt represents a tiny fraction of the total seal load of 321 Nt for a 1023 microwell array at 50 MPa seal force, and would represent a tiny fraction of a total seal load of even one tenth of this 50 MPa value.

In certain embodiments, a sensor as described (for example) in Lu, H. et al. ("New ratiometric optical oxygen and pH dual sensors with three emission colors for measuring photosynthetic activity in cyanobacteria," *Journal of Materials Chemistry,* 21 (2011) 19293) may be attached by a casting technique to an aluminum layer of a multi-layer sealing structure. In certain embodiments, prior to deposition, an aluminum surface may be prepared for adequate sensor adhesion using known plasma treatment and/or silanization processes. In certain embodiments, an aluminum surface (without a protective polymer layer) may be treated with acetic acid to prepare the surface for sensor adhesion.

In certain embodiments, one or more sensors or sensor layers may be patterned on a front surface of a flexural layer (e.g., a PET layer having a rubber backing) without traversing through the multi-layer sealing structure. In certain embodiments, one or more sensors or sensor layers may be deposited in one or more microwells. In certain embodiments, one or more sensors may be dispersed in cell medium or may embody intracellular sensors. In certain embodiments, one or more sensors may be arranged to undergo a physical, chemical, or electrical change upon being exposed to selected conditions.

In certain embodiments, various layers of a multi-layer sealing structure may be selected and/or optimized based on the required maximum particle size to be accommodated. In certain embodiments, presence of particulate contamination may be modeled as a solid mechanic problem described as a plate on an elastic foundation with point loading.

In certain embodiments, a back compliant layer arranged on the rear of the flexural layer, may include or embody a pressure sensitive adhesive (PSA).

In certain embodiments, an aluminum foil may be laminated on a rubber substrate, with one or more sensors or sensor layers deposited on the aluminum.

In certain embodiments, a sensor structure may be manufactured in large sheet form, and may be die-cut or nibble-cut into pieces of size appropriate for live-cell measurements. In certain embodiments, such dimensions may be approximately 13 mm×13 mm for a 4000 microwell array.

In certain embodiments, a multi-layer sealing structure including one or more flexible sensors or sensor layers may be removed after performance of an assay or drawdown by peeling the multi-layer sealing structure, such as by starting at one end. Such peeling removal can improve cell retention in microwells by reducing hydrodynamic forces on the cell(s). This can enable repeated assay tests to be performed on the same cells under varying conditions such as drug treatment. Certain embodiments are directed to a method for arranging cellular material in a microwell array. The method includes arranging cells or groups of cells in microwells of the microwell array, wherein each microwell of the microwell array includes a raised lip; and applying the multi-layer sealing structure as disclosed herein over the raised lip of each microwell of a microwell array to seal the cells or groups of cells in the microwells of the microwell arrays. In certain embodiments, the method further comprises removing at least a portion of the multi-layer sealing structure from at least some microwells of the microwell array by peeling the multi-layer sealing structure away from at least a portion of the microwell array.

In certain embodiments, one or more sensors associated with a multi-layer sealing structure and/or a microwell array may be used to measure one or more analytes associated with live-cell metabolism, such as oxygen concentration and/or pH.

Upon reading the following description in light of the accompanying drawing figures, those skilled in the art will understand the concepts of the disclosure and will recognize applications of these concepts not particularly addressed herein. Those skilled in the art will recognize improvements and modifications to the preferred embodiments of the present disclosure. All such improvements and modifications are considered within the scope of the concepts disclosed herein and the claims that follow.

What is claimed is:

1. A multi-layer sealing structure for sealing a microwell array defined in or on a substrate, the multi-layer sealing structure comprising:

at least one front compliant layer;

a back compliant layer; and a flexural layer arranged between the at least one front compliant layer and the back compliant layer, wherein an entirety of the at least one front compliant layer is closer than an entirety of the back compliant layer to the substrate; and wherein an entirety of a surface of the at least one front compliant layer is optically reflective.

2. The multi-layer sealing structure of claim 1, wherein the at least one front compliant layer comprises aluminum.

3. The multi-layer sealing structure of claim 1, wherein the at least one front compliant layer comprises a plurality of front compliant layers.

4. The multi-layer sealing structure of claim 3, wherein one front compliant layer of the plurality of front compliant layers comprises a sensor layer.

5. The multi-layer sealing structure of claim 4, further comprising a polymeric coating arranged between the sensor layer and the at least one front compliant layer.

6. The multi-layer sealing structure of claim 3, wherein the at least one front compliant layer comprises a thickness in a range of from 0.06 μm to 100 μm.

7. The multi-layer sealing structure of claim 1, wherein the back compliant layer comprises an adhesive.

8. The multi-layer sealing structure of claim 1, wherein the back compliant layer comprises an acrylic adhesive tape or a foam adhesive tape.

9. The multi-layer sealing structure of claim 1, wherein the back compliant layer comprises foam rubber.

10. The multi-layer sealing structure of claim 1, wherein the back compliant layer comprises solid rubber.

11. The multi-layer sealing structure of claim 1, wherein the back compliant layer comprises silicone rubber.

12. The multi-layer sealing structure of claim 1, wherein the flexural layer comprises a polymeric material.

13. The multi-layer sealing structure of claim 12, wherein the flexural layer comprises polyethylene terephthalate (PET).

14. The multi-layer sealing structure of claim 12, wherein the flexural layer comprises aluminum.

15. The multi-layer sealing structure of claim 12, wherein the flexural layer comprises a thickness in a range of from 25 μm to 100 μm.

16. The multi-layer sealing structure of claim 12, wherein the flexural layer comprises at least one of the following characteristics (i) or (ii): (i) a plate constant, D, in a range of from 8 kNm to 7000 kNm, or (ii) a modulus of elasticity of at least 1000 MPa.

17. A microfluidic device comprising a substrate defining a microwell array, and the multi-layer sealing structure of claim 1 arranged to seal the microwell array.

18. A method for arranging cellular material in a microwell array, the method comprising:

arranging cells or groups of cells in microwells of the microwell array, wherein each microwell of the microwell array includes a raised lip; and applying the multi-layer sealing structure of claim 1 over the raised lip of each microwell to seal the cells or groups of cells in the microwells of the microwell array.

19. The method of claim 18, further comprising removing at least a portion of the multi-layer sealing structure from at least some microwells of the microwell array by peeling the multi-layer sealing structure away from at least a portion of the microwell array.

* * * * *